US007857247B2

(12) United States Patent
Sulaiman et al.

(10) Patent No.: US 7,857,247 B2
(45) Date of Patent: Dec. 28, 2010

(54) MILLING SYSTEM

(76) Inventors: Brian Sulaiman, Kastandehe, East Park Street, Morley, Leeds (GB) LS27 0JP; Abdul Karem Souleyman, 3 Sparkfield, Mapplewell, Barnsley (GB) S75 6BH ( * ) Notice: Subject to any disclaimer, the term of this patent is extended or adjusted under 35 U.S.C. 154(b) by 227 days.

(21) Appl. No.: 11/991,804

(22) PCT Filed: Aug. 14, 2006

(86) PCT No.: PCT/GB2006/003017

§ 371 (c)(1),
(2), (4) Date: Mar. 11, 2008

(87) PCT Pub. No.: WO2007/020407

PCT Pub. Date: Feb. 22, 2007

(65) Prior Publication Data

US 2008/0251617 A1 Oct. 16, 2008

(30) Foreign Application Priority Data

Aug. 12, 2005 (GB) ..... 0516549.3

(51) Int. Cl.
*B02C 17/16* (2006.01)

(52) U.S. Cl. ..... 241/172

(58) Field of Classification Search ..... 241/170, 241/172

See application file for complete search history.

(56) References Cited

U.S. PATENT DOCUMENTS 3,770,214 A 11/1973 Gabor
3,861,652 A 1/1975 Clark et al.
3,969,037 A 7/1976 Steiner
4,225,092 A * 9/1980 Matter et al. ..... 241/46.017
4,703,896 A * 11/1987 Fabian et al. ..... 241/172
4,826,089 A 5/1989 Psaltopoulos
4,856,717 A * 8/1989 Kamiwano et al. ..... 241/65
4,915,307 A * 4/1990 Klimaschka et al. ..... 241/65
4,919,347 A * 4/1990 Kamiwano et al. ..... 241/65
4,936,689 A 6/1990 Federighi et al.

(Continued)

FOREIGN PATENT DOCUMENTS

DE 2 262 016 6/1974

(Continued)

OTHER PUBLICATIONS

English translation of Chinese Office Action dated Dec. 25, 2009 issued in connection with Chinese Application No. 200680036763.5.

(Continued)

*Primary Examiner*—Faye Francis
(74) *Attorney, Agent, or Firm*—Nixon & Vanderhye P.C.

(57) ABSTRACT

A milling apparatus containing a radially symmetrical sleeve having an axial passageway with an upstream inlet and a downstream outlet or vice versa, a radially symmetrical rotor located within the sleeve, one of the rotor and sleeve being rotatable relative to the other, the diameter of the rotor being less than the diameter of the sleeve at each axial position to define an annular passageway between the rotor and sleeve, one or both of the surfaces of the rotor and sleeve having formations adapted to increase the surface area encountered by particles in a fluid flow from the inlet to the outlet.

32 Claims, 8 Drawing Sheets

U.S. PATENT DOCUMENTS

| | | | | |
|---|---|---|---|---|
| 5,069,393 | A * | 12/1991 | Kamiwano et al. | 241/46.17 |
| 5,145,684 | A | 9/1992 | Liversidge et al. | |
| 5,312,188 | A | 5/1994 | Ashe | |
| 5,318,767 | A | 6/1994 | Liversidge et al. | |
| 5,346,145 | A * | 9/1994 | Kamiwano et al. | 241/172 |
| 5,379,952 | A * | 1/1995 | Geiger | 241/65 |
| 5,399,363 | A | 3/1995 | Liversidge et al. | |
| 5,451,393 | A | 9/1995 | Liversidge et al. | |
| 5,494,683 | A | 2/1996 | Liversidge et al. | |
| 5,510,118 | A | 4/1996 | Bosch et al. | |
| 5,518,187 | A | 5/1996 | Bruno et al. | |
| 5,534,270 | A | 7/1996 | De Castro | |
| 5,552,160 | A | 9/1996 | Liversidge et al. | |
| 5,573,783 | A | 11/1996 | Desieno et al. | |
| 5,622,938 | A | 4/1997 | Wong | |
| 5,654,008 | A | 8/1997 | Herbert et al. | |
| 5,662,883 | A | 9/1997 | Bagchi et al. | |
| 5,665,331 | A | 9/1997 | Bagchi et al. | |
| 5,704,556 | A | 1/1998 | McLaughlin | |
| 5,718,388 | A | 2/1998 | Czekai et al. | |
| 5,862,999 | A | 1/1999 | Czekai et al. | |

FOREIGN PATENT DOCUMENTS

| | | |
|---|---|---|
| DE | 28 13 781 | 12/1978 |
| DE | 34 31 142 | 3/1986 |
| EP | 24 58 841 | 6/1976 |
| EP | 0 169 140 | 1/1986 |
| EP | 0 322 623 | 7/1989 |
| EP | 0 514 562 | 11/1992 |
| EP | 0 610 568 | 8/1994 |
| EP | 0 610 568 A1 | 8/1994 |
| EP | 1 180 062 | 3/2004 |
| FR | 2 634 625 | 2/1990 |
| GB | 2 086 249 | 5/1982 |
| GB | 1 486 495 | 9/1997 |
| WO | WO 97/04756 | 2/1997 |
| WO | WO 01/13889 A1 | 3/2001 |
| WO | 2006/111380 | 10/2006 |

OTHER PUBLICATIONS

International Search Report for PCT/GB2006/003017 dated Apr. 19, 2007.

Written Opinion of the International Searching Authority dated Apr. 19, 2007.

Sulaiman et al, "Nanoparticles for Pharmaceutical Development", published in *Pharmaceutical Online* on Jul. 11, 2000, pp. 1-4.

International Search Report dated Jun. 12, 1992, issued in connection with PCT/GB92/00311.

* cited by examiner

MILLING SYSTEM

This application is the U.S. national phase of International Application No. PCT/GB2006/003017 filed 14 Aug. 2006 which designated the U.S. and claims priority to GB Application No. 0516549.3 filed 12 Aug. 2005, the entire contents of each of which are hereby incorporated by reference.

This invention relates to apparatus for milling or comminuting of particulate materials, particularly but not exclusively materials in liquid suspensions. The invention also relates to apparatus for forming emulsions or finely divided mixtures of different liquids. The invention also relates to apparatus for reactive processing of materials, for example reactive mixing of polymers or monomers to produce a finely divided reactive mixture, for example on the nanometric scale.

Ball mills, bead mills and colloidal mills are well known. These generally comprise a cylinder with smooth internal surfaces into which grinding media are placed. These mills may have internal paddles with cutting edges having various shapes and radii allowing movement of the grinding media at high speed.

According to the present invention milling apparatus comprises a radially symmetrical sleeve having an axial passageway with an upstream inlet and a downstream outlet or vice versa, a radially symmetrical rotor located within the sleeve, one of the rotor and sleeve being rotatable relative to the other, the diameter of the rotor being less than the diameter of the sleeve at each axial position to define an annular passageway between the rotor and sleeve, one or both of the surfaces of the rotor and sleeve having formations adapted to increase the surface area encountered by particles in a fluid flow from the inlet to the outlet.

The apparatus of this invention may comprise a bead mill using beads or other particulate media. Alternative embodiments not employing beads or particulate media may be used.

In a preferred embodiment the rotor is located co-axially within the sleeve. In an alternative embodiment the axis of the rotor may be displaced parallel to the axis to the sleeve.

When beads or other grinding media are used the radial width of the annular passageway may be about twice the diameter of the beads or other particulate media. A single size of beads or other media is preferred.

The rotor and sleeve are preferably frustoconical. Alternatively they may be concave or convex bell shaped. A frustoconical configuration is preferred. Alternatively the rotor may be oval or elliptical in cross-section.

In preferred embodiments the diameter of the inlet is smaller than the diameter of the outlet. In alternative embodiments the diameter of the inlet is greater than the diameter of the outlet.

When the rotor is frustoconical, the apical angle may be in the range of 10-140° preferably to 20-90° Greater angles provide various benefits without increasing the length of the apparatus in comparison to a conventional mill having the same inlet diameter. A greater angle provides a greater increase in surface area from the inlet to the outlet, increasing the residence time and extent of milling as a particle passing through the system. The total volume and hence capacity of the mill is also increased. Greater angles are preferred for high viscosity applications and for production of nanometric particles, reducing the liability of blockage on such a small scale.

Either the rotor or sleeve can rotate. Alternatively both the rotor and sleeve can rotate in opposite directions.

A further alternative the rotor and sleeve may be rotated in the same direction at different speeds. This arrangement may be employed when two or more devices in accordance with this invention are connected in series to control the rate of pumping through the apparatus.

The rate of rotation of the rotor relative to the sleeve may be 2-3600 rpm, for example 900-1600 rpm.

The separation between the rotor and sleeve is preferably constant along the axis of the apparatus. A separation of 0.00001 to 200 millimeters, preferably 0.05 to 10 mm millimeters may be employed.

In further embodiment the separation between the rotor and the sleeve of the milling is of the order 0.00001 millimeters. Preferably the rotor and the sleeve of the milling system are free from indentation. The material (s) is added under pressure between the rotor and sleeve of the milling system, a pressure of 0.1 to 2000 bar poise, preferably 100 to 500 bar, more preferably 1 to 10 bar.

Alternatively, the separation between the rotor and sleeve may be varied by locating the rotor axis a small distance from the sleeve axis to provide cavitation for high viscosity applications or in situations where no beads are employed.

An array of indentations is provided on the rotor, sleeve or both. The configuration and arrangement of the indentations and the rotor and sleeve may be the same or different in accordance with the requirements of the material to be milled. The indentations may be arranged in a multiplicity of circular arrays disposed longitudinally along the axis of the rotor and/or sleeve, adjacent circular arrays preferably being arranged in axially offset configuration so that corresponding portions of adjacent arrays do not coincide.

In preferred embodiments the diameter of the beads or other particles is 10-2000 μm, preferably 50-800 μm, more preferably 50-200 μm (nano-size).

The depth of the indentations is at least 4 times the diameter of the beads.

In alternative embodiments the rotor may carry the pattern or raised superficial projections. The projections are preferably arranged to form channels so as to purge the beads or particles together and also to cause rotation of the beads in use.

In a preferred embodiment 4 to 100, preferably 8 circular arrays may be provided.

Each indentation may comprise a wedge shape slot which may be generally triangular in cross-section, having a maximum depth at the leading edge relative to the direction of rotation, tapering towards the annular cavity at the trailing edge.

Alternatively each indentation may comprise a first surface extending radially inwardly from the circumference of the rotor and a tangential surface joining the inner most edge of the radial surface to form a half chordate cut out portion.

Alternatively the indentations may be curved in the longitudinal direction of the apparatus so that each indentation is trough or cup shaped with a steep surface at the leading edge and tapering at the trailing edge.

Apparatus in accordance with this invention has the advantage that liquid is pumped from the inlet to the outlet by rotation of the rotor to facilitate flow of material through the apparatus is facilitated without the need for a separate pump.

Cavitation affects during use of apparatus in accordance with this invention causes the beads to recycle and re-distribute within the chamber. This is an important benefit arising from use of indentations and apparatus in accordance with the invention. Apparatus without the indentations or projections would permit the beads to collect in the outlet preventing efficient milling.

In preferred embodiments the beads or particles occupy up to 98% of the volume of the chamber, preferably 10-95%, more preferably 75-95%.

Two or more apparatus in accordance with the present invention may be connected together so that liquid flows successively from one to another. The larger diameter outlet of a first apparatus may be connected to the smaller diameter inlet of the following apparatus. Alternatively, the second apparatus may be connected in reverse configuration with a larger diameter inlet and smaller diameter outlet, the larger diameter portions of the adjacent apparatus being connected together. The apparatus may also be connected to a conventional ball or bead mill.

Apparatus in this invention may be disposed vertically or horizontally or at any convenient angle. This may be contrasted to a conventional bead mill in which the affect of gravity limits the orientation in which it may be used.

The apparatus may be used for processing various materials of different physical and chemical properties. High viscosity materials such as rubber or putty in which the viscosity is up to 4000 poise may be processed. Materials with a high solid content up to 95% or low solid contents below 1% may be processed by appropriate selection of the configuration of the rotor and sleeve. Particle size distribution be controlled and a greater degree of efficiency and note of milling in comparison to a conventional bead mill is observed.

An apparatus in accordance with this invention may be used in manufacture of ink, for example nano-metric ink, inkjet printers, pharmaceutical powders, ceramics, food products, agrochemicals and polymers for coatings, for example for protection clothing and body armour.

A preferred apparatus in accordance with this invention may have one or more paddles, blades or other formations on the downstream face of the rotor, adapted to urge the milled material through an outlet mesh or screen. This provides a pumping action and is particularly beneficial when handling viscose fluid materials.

The invention is further described by means of example but not in a limitative sense in reference to the accompanying drawings of which:

Figure 1:
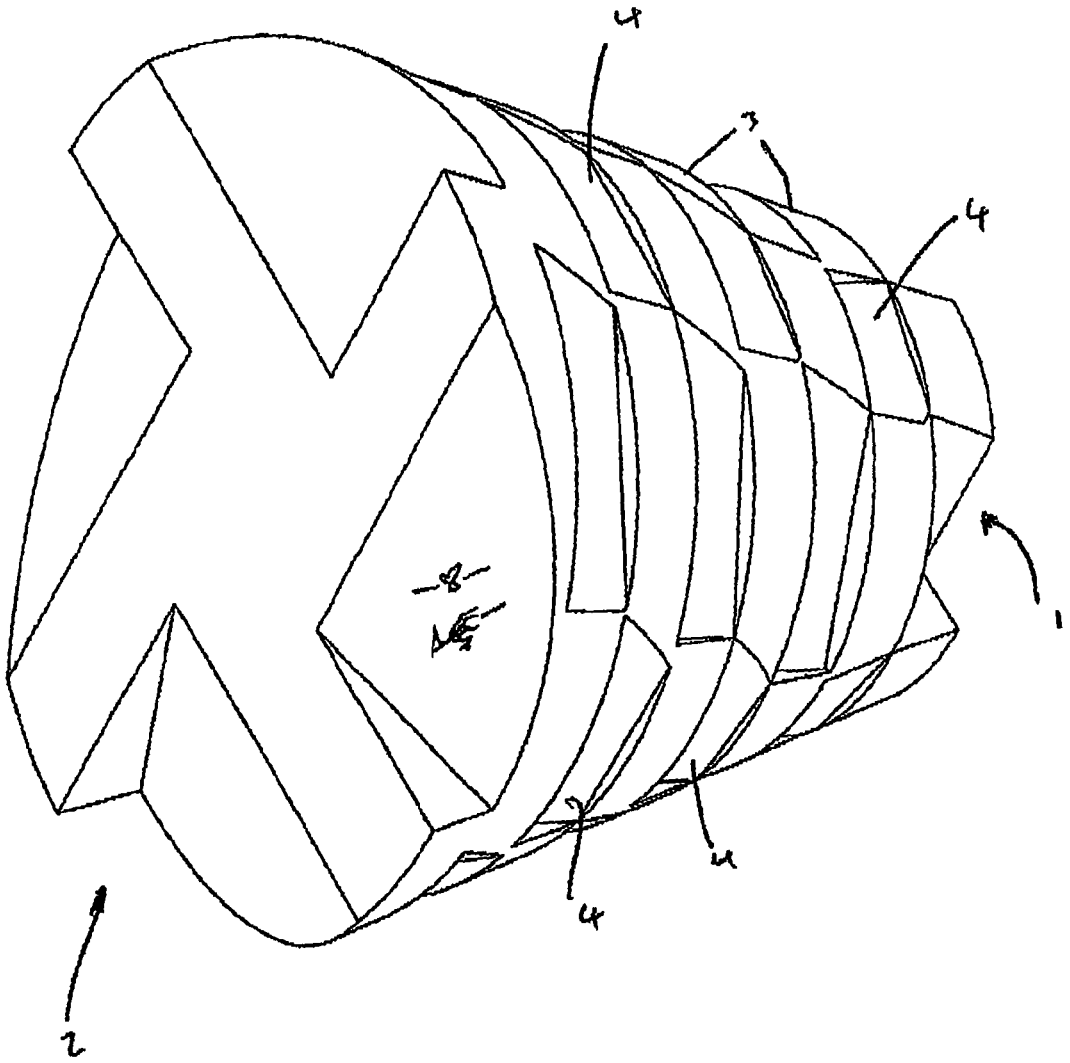
FIG. 1 is a prospective view of a rotor of a mill in accordance with this invention.
Figure 2:
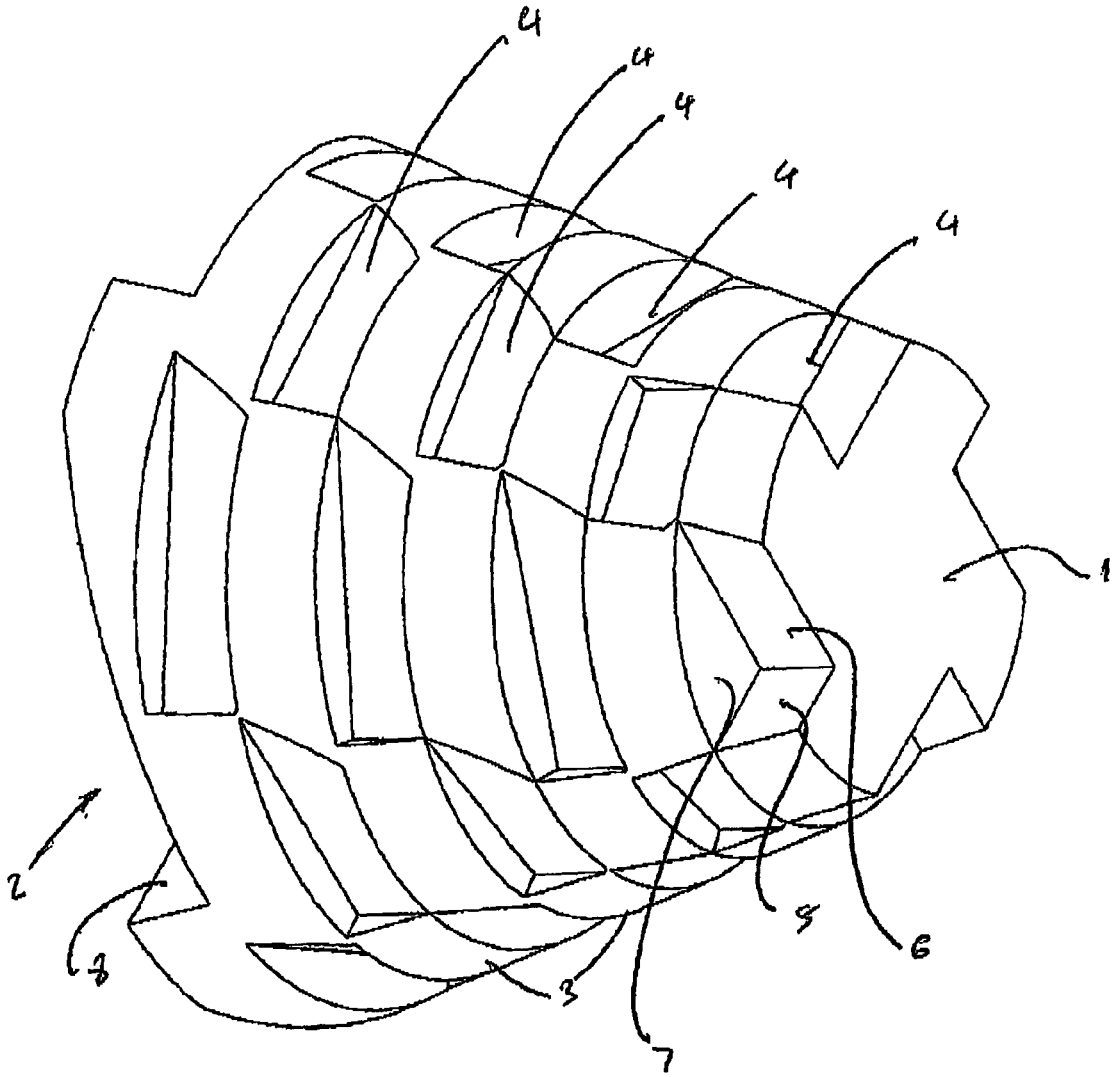
FIG. 2 is an alternative prospective view of the rotor shown in FIG. 1.
Figure 3:
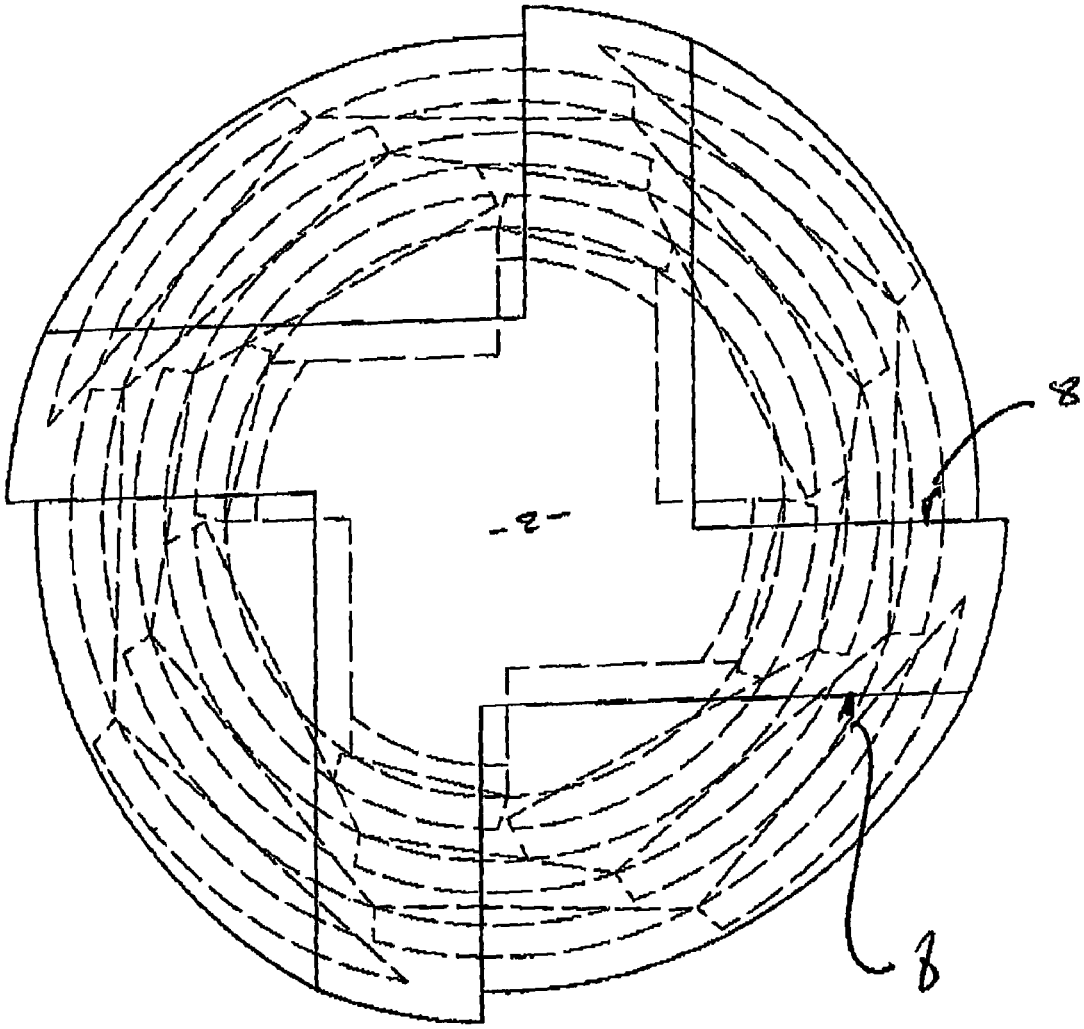
FIG. 3 is an end elevation of the rotor shown in FIGS. 1 and 2.
Figure 4:
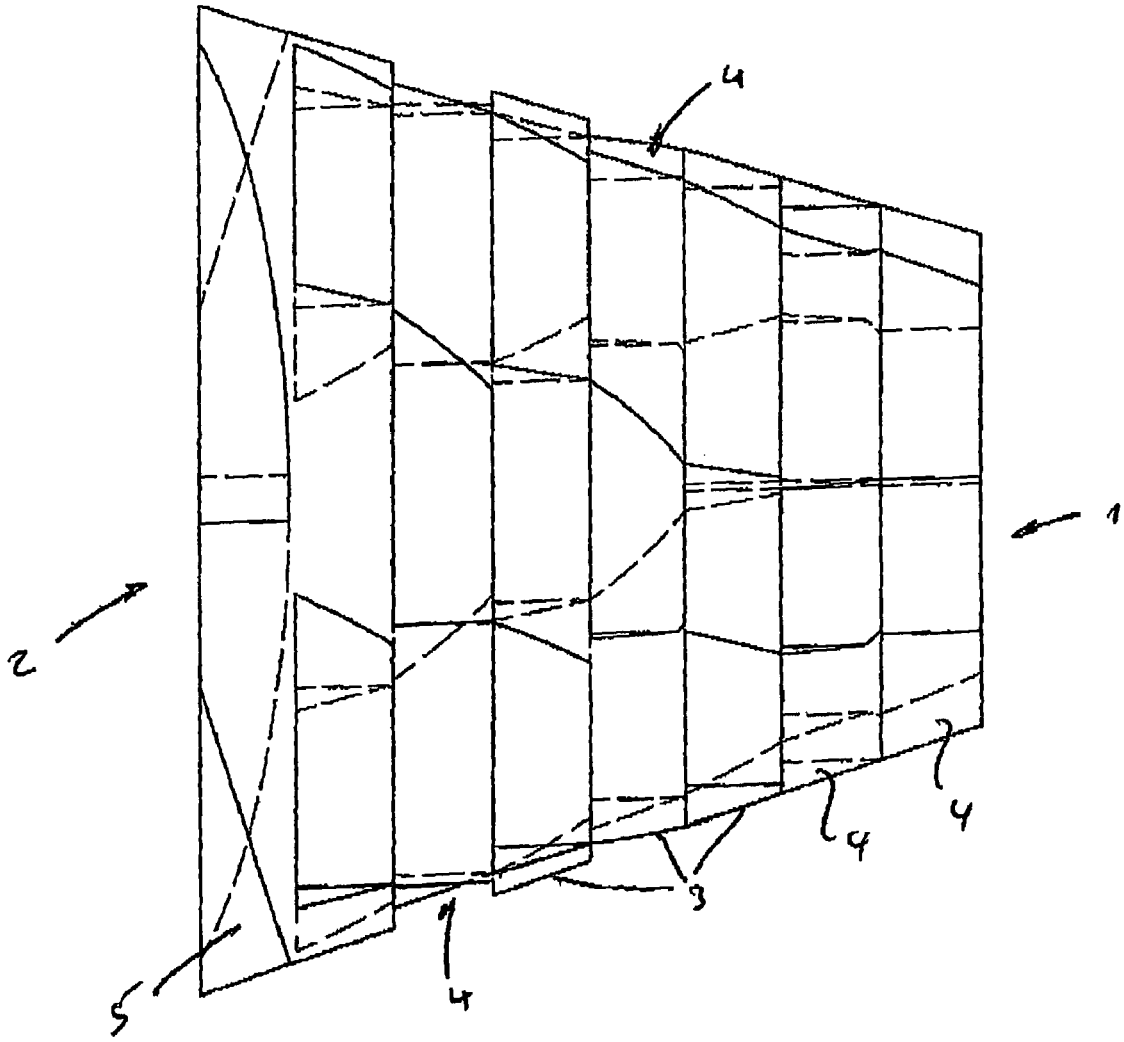
FIG. 4 is a side elevation of the rotor.

FIGS. 1 to 6 illustrate a milling apparatus in accordance with the present invention. The rotor shown in FIGS. 1 to 4 is generally frustoconical in shape and comprises a first end (1) having a smaller diameter than the second end (2). The frustoconical surface of the rotor has an apical angle of 10-140° preferably 20-90°. Axial segments (3) of the rotor define adjacent arrays of indentations (4) spaced circumferentially around each segment. Each indentation (4) comprises a radially inwardly extending surface, for example as shown at (5) in FIG. 2, adjoining a tangentially extending chordate surface (6) and a radially side portion (7). The indentation forms a right-angled cut out in the surface of the rotor. Indentations in adjacent arrays are duly offset to provide an extended pathway for a particle passing on the length of the rotor.

The large diameter end of the rotor (2) includes four cut away portions which define an axial pump to drive fluid passing through the milling apparatus through a bead retaining mesh or screen (not shown).

Figure 5:
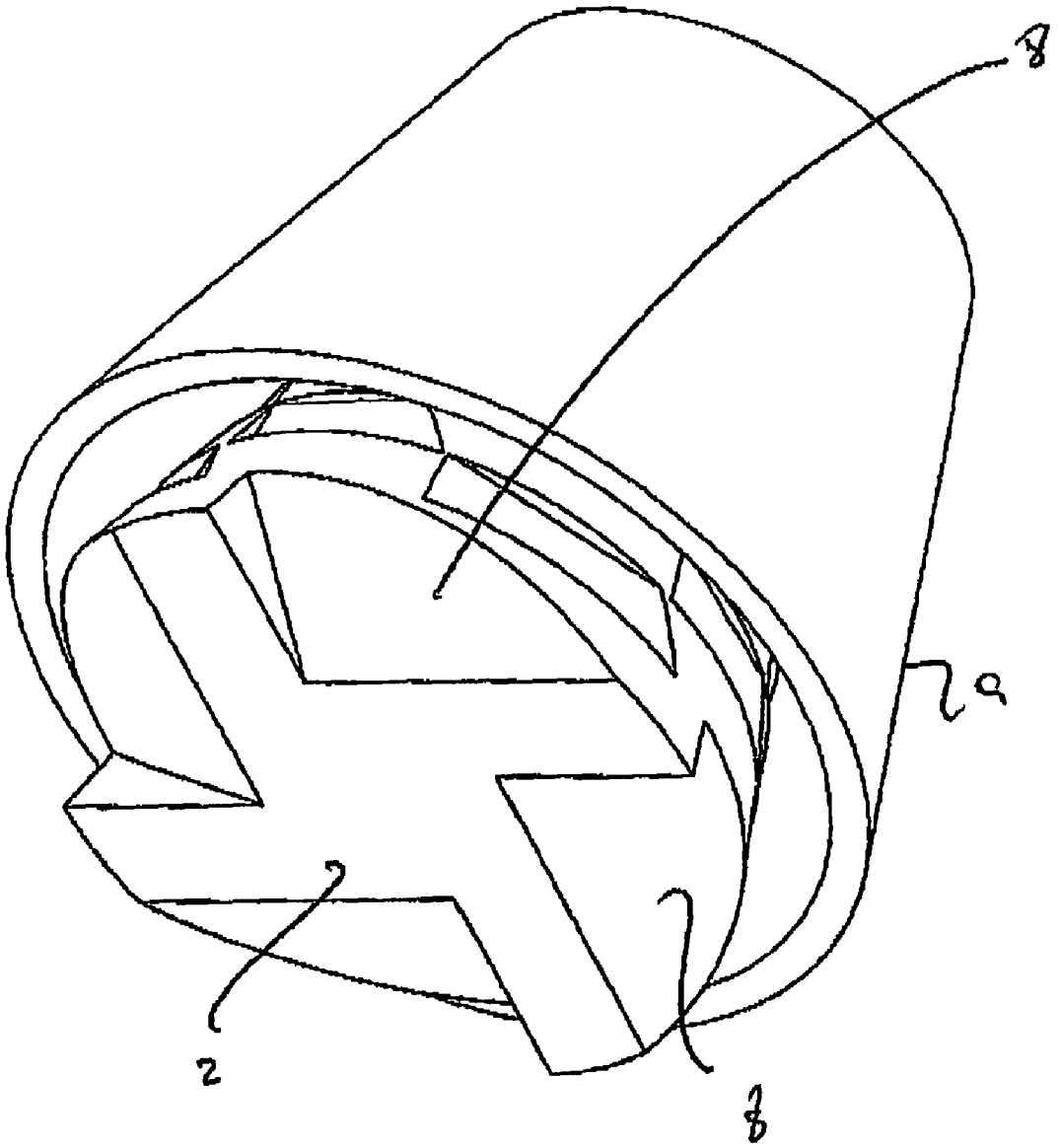
FIG. 5 is a prospective view of a rotor received within a sleeve.
Figure 6:
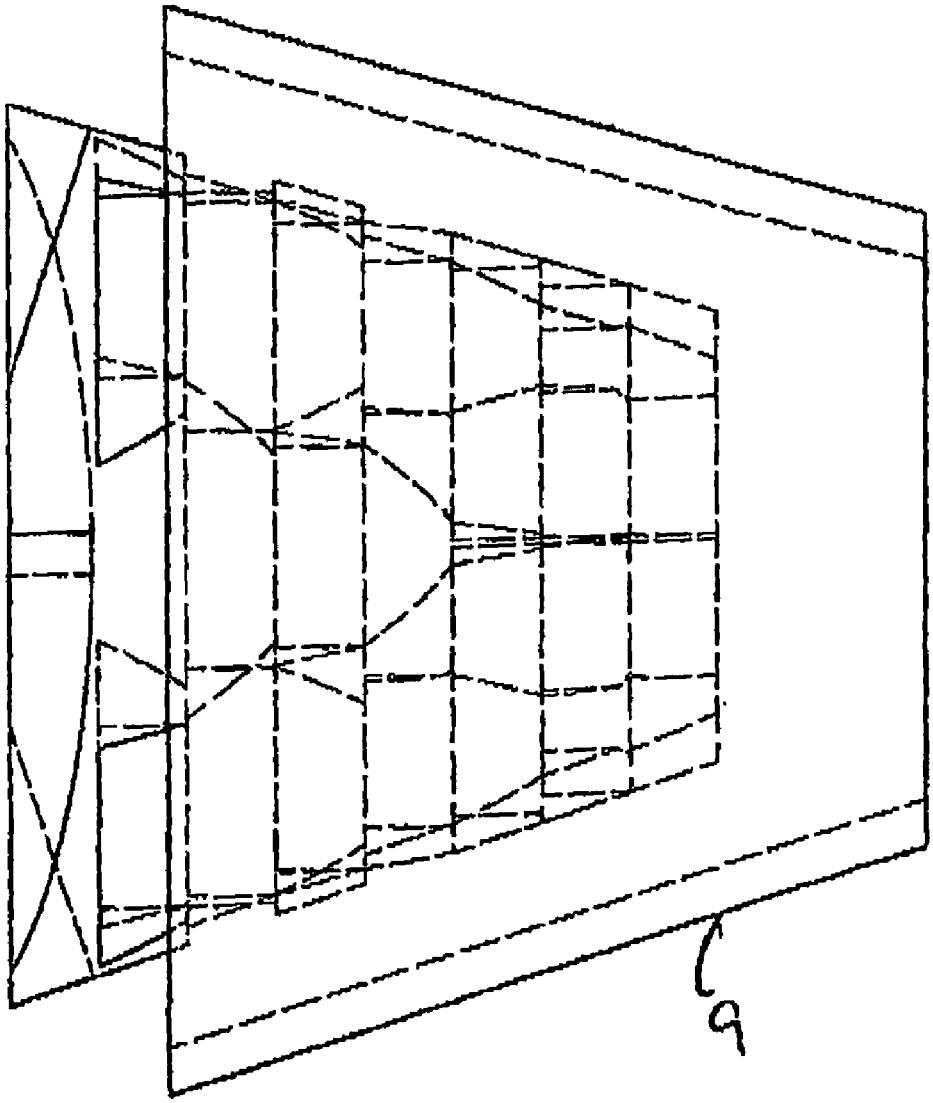
FIG. 6 is a cross-sectional view of the rotor and sleeve shown in FIG. 5.
Figure 7:
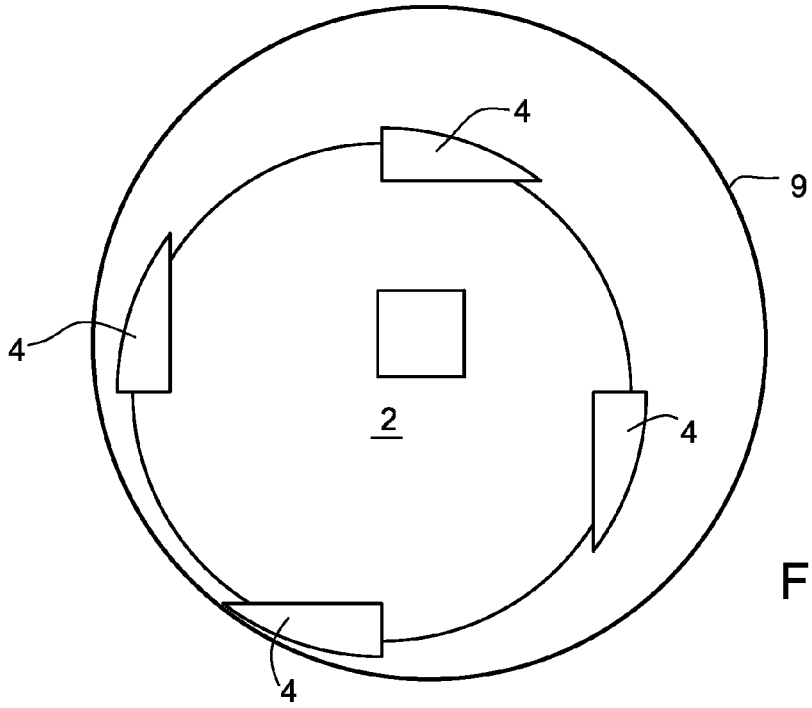
FIG. 7 is a cross sectional view of an alternative milling apparatus of the present disclosure.
Figure 8:
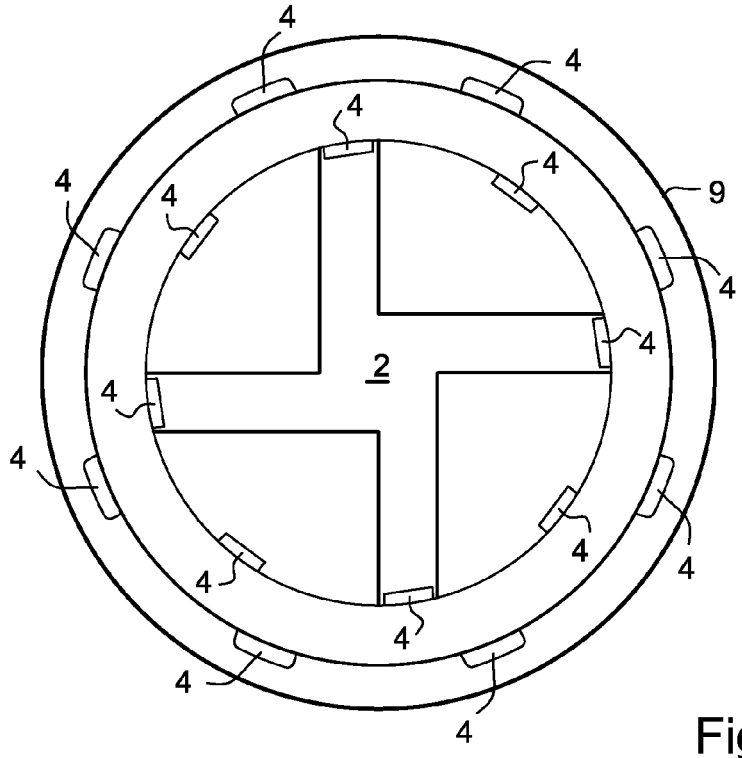
FIG. 8 is a cross sectional view of an alternative milling apparatus of the present disclosure.
Figure 9:
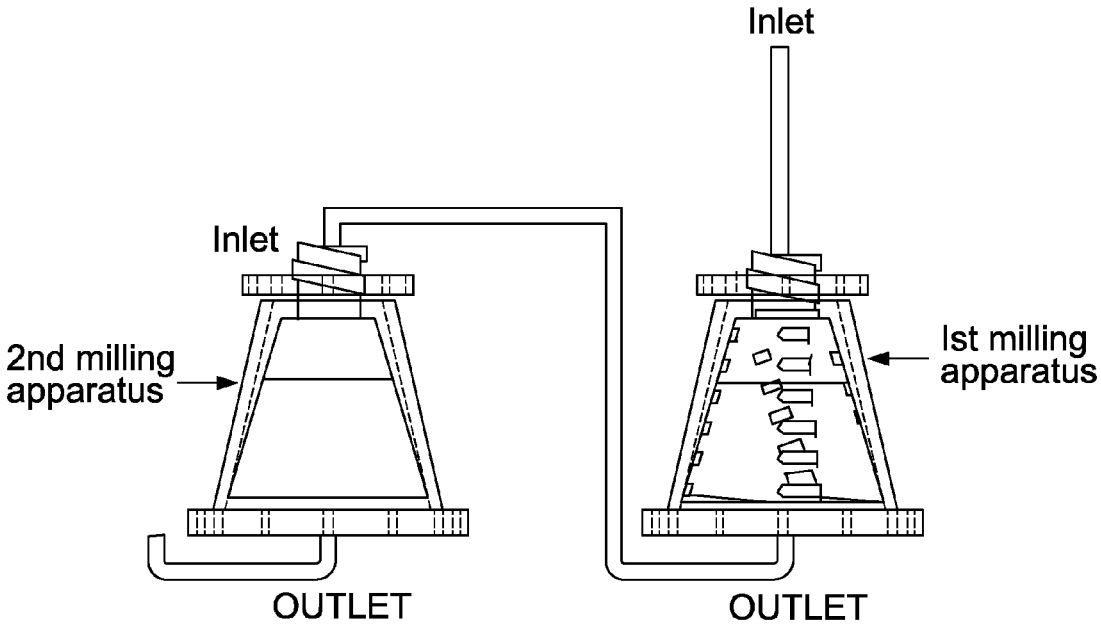
FIG. 9 is a schematic diagram showing a combined milling apparatus of the present disclosure.

FIGS. 5 and 6 show the rotor received in a conical sleeve (9), the sleeve having a smooth frustoconical internal surface. In use the separation between the rotor and sleeve is constant on the length of the apparatus and may range from 0.00001-200 mm.

The invention claimed is:

1. A milling apparatus comprising a radially symmetrical sleeve having an axial passageway with an upstream inlet and a downstream outlet, a radially symmetrical rotor located within the sleeve, either or both of the rotor and sleeve being rotatable relative to the other, the diameter of the rotor being less than the diameter of the sleeve at each axial position to define an annular passageway between the rotor and sleeve, one or both of the surfaces of the rotor and sleeve having formations adapted to increase the surface area encountered by particles in a fluid flow from the inlet to the outlet, wherein the rotor and the sleeve are frustoconical, the diameter of the inlet being smaller than the diameter of the outlet, and wherein the rotor carries an array of indentations, the array comprising a plurality of adjacent circular arrays, the arrays being arranged in axially offset configuration such that corresponding portions of adjacent arrays do not coincide.

2. A milling apparatus as claimed in claim 1, comprising a bead mill.

3. A milling apparatus as claimed in claim 1, wherein the rotor is located co-axially with the sleeve.

4. A milling apparatus as claimed in claim 1, wherein the axis for the rotor is displaced parallel to the axis of the sleeve.

5. A milling apparatus as claimed in claim 1, wherein the apical angle of the frustoconical rotor is in the range from 10 to 140°.

6. A milling apparatus as claimed in claim 5, wherein the apical angle of the frustoconical rotor is in the range from 20 to 90°.

7. A milling apparatus as claimed in claim 1, wherein at least one of the sleeve and the rotor is free to rotate.

8. A milling apparatus as claimed in claim 7, wherein both the sleeve and the rotor are free to rotate.

9. A milling apparatus as claimed in claim 1, wherein the sleeve and rotor are free to rotate in opposite directions.

10. A milling apparatus as claimed in claim 1, wherein the sleeve and rotor are adapted to rotate in the same direction at different speeds.

11. A milling apparatus as claimed in claim 1, wherein the rate of rotation of the rotor relative to the sleeve is in the range from 300 to 3600 rpm.

12. A milling apparatus as claimed in claim 11, wherein the rate of rotation of the rotor relative to the sleeve is in the range from 900 to 1600 rpm.

13. A milling apparatus as claimed in claim 1, wherein the separation between rotor and sleeve is constant along the axis of the apparatus.

14. A milling apparatus as claimed in claim 13, wherein the separation between rotor and sleeve is in the range from 0.01 mm to 90 mm.

15. A milling apparatus as claimed in claim 4, wherein the separation between rotor and sleeve is in the range from 0.05 to 1 mm.

16. A milling apparatus as claimed in claim 1, wherein both the rotor and sleeve comprise an array of indentations.

17. A milling apparatus as claimed in claim 16, wherein the arrangement of indentations on the rotor and sleeve are the same.

18. A milling apparatus as claimed in claim 16, wherein the arrangement of indentations on the rotor and sleeve are different.

19. A milling apparatus as claimed in claim 16, wherein the array of indentations comprises between 4 and 100 circular arrays.

20. A milling apparatus as claimed in claim 19, wherein the array of indentations comprises 8 circular arrays.

21. A milling apparatus as claimed in claim 16, wherein at least some of the indentations comprise a wedge shaped slot.

22. A milling apparatus as claimed in claim 21, wherein the indentations are generally triangular in cross section.

23. A milling apparatus as claimed in claim 21, wherein the maximum depth of the indentation is at the leading edge of the indentation relative to the direction of rotation, tapering towards an annular cavity at the trailing edge.

24. A milling apparatus as claimed in claim 1, wherein at least some of the indentations comprise a first surface extending radially inwardly from the circumference of the rotor and a tangential surface joining the inner most edge of the radial surface to form a half chordate cut out portion.

25. A milling apparatus as claimed in claim 1, wherein at least some of the indentations are curved in the longitudinal direction of the apparatus such that each of the indentations is trough- or cup-shaped with a steep surface at the leading edge and tapering at the trailing edge.

26. A milling apparatus as claimed in claim 1, wherein the rotor comprises one or more formations on its downstream face adapted to urge the milled material through an outlet mesh or screen.

27. A milling apparatus as claimed in claim 1, wherein the rotor carries a pattern of raised superficial projections, the projections preferably being arranged to form channels.

28. A combined milling apparatus comprising first and second milling apparatus as claimed in claim 1, wherein the outlet of the first milling apparatus is connected to the inlet of the second milling apparatus.

29. A milling apparatus as claimed in claim 1, wherein the material to be milled is added between rotor and sleeve under pressure.

30. A milling apparatus as claimed in claim 29, wherein the material to be milled is added between rotor and sleeve under a pressure in the range from 0.1 to 2000 bar.

31. A milling apparatus as claimed in claim 30, wherein the material to be milled is added between rotor and sleeve under a pressure in the range from 100 to 500 bar.

32. A milling apparatus as claimed in claim 20, wherein the material to be milled is added between rotor and sleeve under a pressure in the range from 1 to 10 bar.

* * * * *